US005609042A

United States Patent [19]

Williams

[11] Patent Number: 5,609,042

[45] Date of Patent: Mar. 11, 1997

[54] BREAST ORNAMENT

[76] Inventor: Maybelline Williams, 14213 Longacre, Detroit, Mich. 48227

[21] Appl. No.: 518,356

[22] Filed: Aug. 23, 1995

[51] Int. Cl.[6] ..... A44C 25/00

[52] U.S. Cl. ..... 63/20; 63/33

[58] Field of Search ..... 63/1.1, 3, 4, 2, 63/20; 450/60, 41, 89; 2/244, 245, 246, 67

[56] References Cited

U.S. PATENT DOCUMENTS

| | | | |
|---|---|---|---|
| 521,103 | 6/1894 | Crohn | 63/20 X |
| 3,597,877 | 8/1971 | Speers | 63/1.1 X |
| 3,831,398 | 8/1974 | Davis, Sr. . | |
| 4,065,940 | 1/1978 | Gordon . | |
| 4,096,710 | 6/1978 | Sloan . | |
| 4,270,366 | 6/1981 | Green . | |
| 4,625,526 | 12/1986 | Milawski . | |
| 5,239,841 | 8/1993 | Zwart . | |

*Primary Examiner*—Kien T. Nguyen
*Attorney, Agent, or Firm*—Brooks & Kushman, P.C.

[57] ABSTRACT

A jewelry ornament for accentuating a pair of breasts is provided. The ornament comprises an elongate stem, a mount and a decoration. The elongate stem has a first end portion and a second end portion. The mount is attached to the second end portion and a decoration is secured by the mount to the second end portion. The ornament may be placed in and retained in the cleavage defined between a pair of breasts with the decoration being visibly displayed. The ornament may include a pair of support arms which cooperatively abut the breasts to assist in positioning the ornament. Also, a fastener may be included in the ornament to affix the ornament to an article of clothing, such as a brassiere. The method includes mounting the ornament in the cleavage formed between a pair of breasts.

16 Claims, 1 Drawing Sheet

BREAST ORNAMENT

TECHNICAL FIELD

This invention relates generally to jewelry, and more specifically, to jewelry which is worn in the upper chest and neck region.

BACKGROUND OF THE INVENTION

Jewelry is used to adorn various parts of the body. Examples include necklaces, broaches, wrist bracelets, earrings etc. Other more exotic types of ornaments which have been patented include a navel button, U.S. Pat. No. 3,831,398 and nipple rings in U.S. Pat. Nos. 4,625,536 and 5,239,841.

The present invention is intended to provide an ornament which provides a further choice in body ornamentation.

SUMMARY OF THE INVENTION

A jewelry ornament for accentuating a pair of breasts is provided. The ornament comprises an elongate stem, a mount and a decoration. The elongate stem has a first end portion and a second end portion. The mount is attached to the second end portion and a decoration is secured by the mount to the second end portion. The ornament may be placed in and retained in the cleavage defined between a pair of breasts with the decoration being visibly displayed.

Preferably, the first end portion is blunt so as not to scratch a wearer of the ornament. The ornament may further include at least one support arm extending laterally from the elongate stem. The support arm is structurally configured to abut a breast when worn by a user to assist in the positioning of the ornament in the cleavage. A fastener ideally is secured to the first end portion for affixing the elongate stem to an article of clothing, such as a brassiere.

A method of mounting a jewelry ornament to a wearer is also taught. The jewelry ornament is provided which has an elongate stem including a first end portion and a second end portion with a mount attached to the second end portion which holds a decoration. The ornament is inserted into the cleavage formed between a pair of breast with the elongate stem extending generally vertically in the cleavage with the decoration being visibly displayed between the breasts.

The ornament may be adhesively secured to the user's body, affixed using a fastener to a brassiere or other article of clothing, or else simply clampingly captured between breasts which are biased together by some means such as a push-up brassiere.

A pair of support arms may be included with the ornament and the support arms are then positioned against the respective breasts to assist in holding the ornaments in place.

It is an object of the present invention to provide an ornament which accentuates a woman's breasts.

It is another object to provide an item of jewelry which rests in the cleavage formed between a pair of breasts.

It is still a further object to provide an ornament which is releasably mountable to a brassiere, or other article of clothing, such that the ornament is visibly displayed in the cleavage defined by a pair of breasts.

BRIEF DESCRIPTION OF THE FIGURES

These and other features, objects, and advantages of the present invention will become readily apparent from the following description, pending claims, and accompanying sheets of drawings where:

BEST MODE FOR CARRYING OUT THE INVENTION

Figure 1:
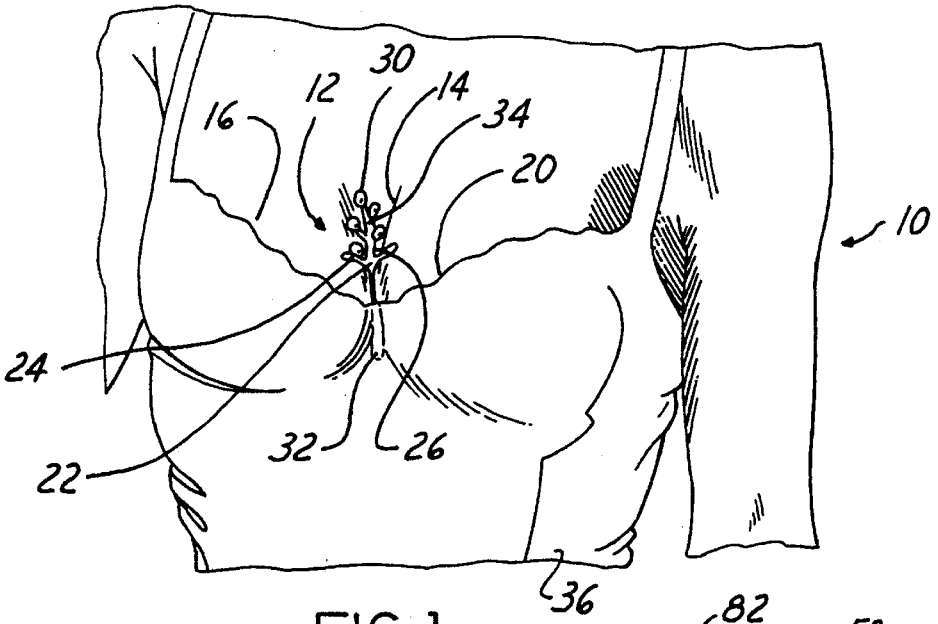
FIG. 1 is a perspective view of an ornament, made in accordance with the present invention, which is disposed in the cleavage formed between a pair breasts.

FIG. 1 shows a user 10 wearing an ornament 12 made in accordance with the present invention. Ornament 12 is captured in the cleavage 14 formed by a left breast 16 and a right breast 20.

Ornament 12 comprises an elongate stem 22, a pair of laterally extending support arms 24 and 26 and a plurality of decorations 30. Elongate stem 22 includes a first end portion 32 and a second end portion 34. First end portion 32 is captured in cleavage 14. Ideally, the user 10 wears an article of clothing, such as a camisole 36, which contains and biases breasts 16 and 20 together to form cleavage 14 such that elongate stem 22 is captured therebetween. Support arms 24 and 26 abut respective breasts 16 and 22 to assist in the positioning of ornament 12 in cleavage 14. Decorations 30, in this case pearls, are mounted to the first end portion 32 of stem 22.

Figure 2:
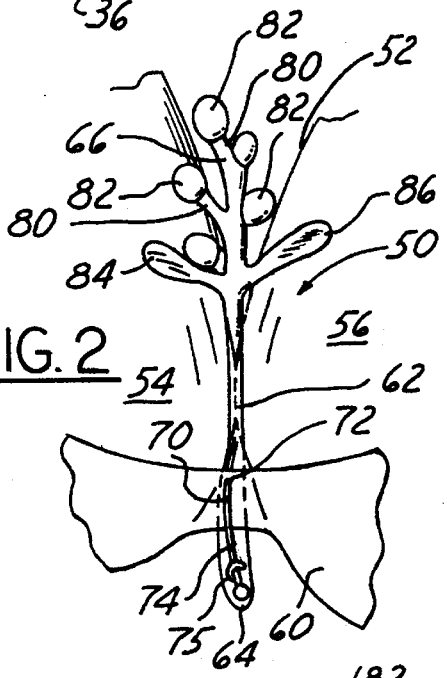
FIG. 2 is an enlarged view of a second embodiment of an ornament which has a pair of support arms and a fastener which mounts to an article of clothing such as a brassiere.

FIG. 2 shows a second embodiment of an ornament 50 which is captured in the cleavage 52 formed between left and right breast 54 and 56. Again, ideally an article of clothing, in this case a brassiere 60 is used to bias breasts 54 and 56 together. Ideally, breasts 54 and 56 will abut one another.

Ornament 50 includes an elongate stem 62 having a first end portion 64 and a second end portion 66. Preferably, the end of first end portion 64 is blunt so as not to scratch a user. Mounted on first end portion 64 is a cantilevered pin 70 which is adapted to pierce brassiere 60 in at least one location 72 such that ornament 50 is prevented from falling from within cleavage 52. The sharp end of pin 70 bears upon a portion of lower end portion 64 such that the pin will not scratch the user. A snap 75 springingly retains pin 70 therebeneath. Second end portion 66 of elongate stem 62 has a plurality of branches 80 upon which are adhesively mounted decorations such as pearls 82. A pair of laterally extending support arms 84 and 86 abut breasts 54 and 56 to maintain ornament 50 in a desired orientation.

Figure 3:
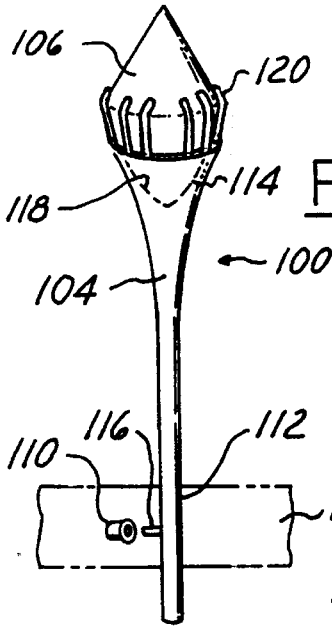
FIG. 3 is a perspective view of a third embodiment of an ornament.

FIG. 3 depicts a third embodiment of an ornament 100 which attaches to the strap of a brassiere 102. Ornament 100 includes an elongate stem 104, a decoration such as a diamond 106 and a fastener 110. Elongate stem 104 includes a first end portion 112 and a second end portion 114. First end portion 112 includes a pin 116 which extends laterally and may be used to pierce strap 102. A fastener 120, such as that used on an earring, secures onto the free end of pin 116 to affix ornament 100 to strap 102.

The second end portion 114 includes a socket or mount 118 into which decoration 106 is received. A plurality of bendable fingers 120 are used to retain decoration 106 in socket 118. To mount ornament 100, pin 116 is poked through strap 100 and fastener 110 is then secured over the end of pin 116 securing ornament 100 to brassiere 102. Then, elongate stem 104 is positioned in a cleavage formed between a pair of breasts with ornament 100 being visibly displayed between the pair of breasts.

Figure 4:
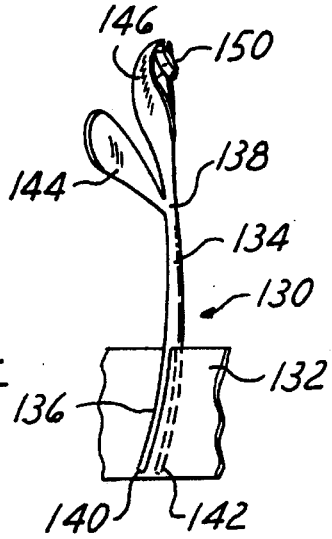
FIG. 4 is a perspective view of a fourth embodiment of an ornament which has a pair of legs which clamp amount a brassiere strap.

FIG. 4 illustrates a fourth embodiment of an ornament 130 which mounts on a brassiere strap 132. Ornament 130 includes an elongate stem 134 having a first end portion 136 and a second end portion 138. First end portion 136 is bifurcated into legs 140 and 142. Legs 140 and 142 clip over the top of a brassiere strap 132. A pair of support arms 144, only one of which is shown, is used to abut a breast for positioning purposes. Support arm 144 attaches to elongate stem 134. A mount 146 with a socket formed therein is integral with the top of second end portion 138 and retains a decoration 150 such as a gemstone.

Figure 5:
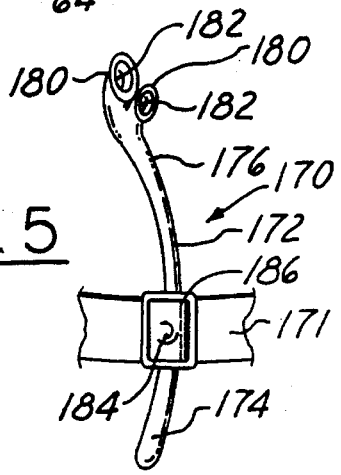
FIG. 5 illustrates a fifth embodiment of an ornament wherein the ornament mounts within an aperture of a brassiere.

Turning now to FIG. 5, a fifth embodiment of an ornament made in accordance with the present invention, designated as 170, is shown. Ornament 170 includes elongate stem 172 having a first end portion 174 and a second end portion 176. First end portion 174 is bulbous at its end providing a blunt surface such that a wearer is not scratched by the free end. Second end portion 176 has a pair of mounts 180 secured thereto which retain decorations or gemstones 182 therein. Located intermediate first end portion 174 and second end portion 176 is a forwardly projecting button 184. Button 184 is adapted to fit within an aperture found within a snap 186 of brassiere 171 which is of the type which fastens and releases from the front.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention.

For example, the decoration may include gem stones such as diamonds, rubies, etc. or else sculptured designs made of precious metals. Methods for attachment of the ornament to a user include adhesion, suction, or mechanical mounting to a piece of clothing. The mount used to attach the decoration to the elongate stem may be any conventional mount used in the art of mounting gemstones or the like.

What is claimed is:

1. A jewelry ornament for accentuating a pair of breasts, the ornament comprising:

an elongate stem having a first end portion and a second end portion;

a mount attached to the second end portion;

a decoration secured by the mount to the second end portion; and a pair of support arm extending laterally from the elongate stem, each arm adapted to abut a respective breast to prevent the elongate stem from rotating when the ornament is worn by a user;

wherein the ornament may be placed and retained in the cleavage defined between a pair of breasts with the decoration being visibly displayed.

2. The ornament of claim 1 wherein:

the first end portion is blunt so as not to scratch a wearer of the ornament.

3. The ornament of claim 1 further comprising:

a fastener secured to the first end portion for affixing the elongate stem to an article of clothing.

4. A jewelry ornament for accentuating a pair of breasts, the ornament comprising:

an elongate stem having a first end portion and a second end portion;

a fastener secured to the first end portion for affixing the elongate stem to an article of clothing;

a mount attached to the second end portion; and a decoration secured by the mount to the second end portion;

wherein the ornament may be placed and retained in the cleavage defined between a pair of breasts with the decoration being visibly displayed.

5. The ornament of claim 1 wherein:

the decoration includes at least one gemstone.

6. The ornament of claim 1 wherein:

the decoration comprises a precious metal.

7. The ornament of claim 6 wherein:

the decoration comprises gold.

8. A method of mounting a jewelry ornament to a wearer comprising:

providing an ornament which has an elongate stem including a first end portion and a second end portion with a mount attached to the second end portion which holds a decoration; and inserting the ornament into the cleavage formed between a pair of breasts with the elongate stem extending vertically in the cleavage with the decoration being visibly displayed between the breasts.

9. The method of claim 8 further comprising:

adhesively securing the ornament to the user's body.

10. The method of claim 8 wherein:

the breasts are biased together to form a cleavage which abutting retains the ornament between the breasts with no further retainment needed to hold the ornament in place.

11. The method of claim 10 wherein:

the breasts are biased together using a brassiere.

12. The method of claim 8 wherein:

the ornament includes at least one laterally extending support arm; and abuttingly positioning the at least one laterally extending support arm against a breast to hold the ornament in place.

13. The method of claim 8 wherein:

the elongate stem has a fastener affixed thereto; and securing the fastener to an article of clothing to prevent the ornament from being dislodged from the cleavage.

14. The method of claim 13 wherein:

the article of clothing is a brassiere.

15. A jewelry ornament comprising:

an elongate stem having a blunt first end portion and a second end portion;

a mount secured to the second end portion;

a decoration held by the mount; and a fastener secured to the first end portion;

wherein the ornament may be placed in the cleavage defined between a pair of breasts and the fastener is affixable to an article of clothing to hold the ornament in position in the cleavage.

16. The ornament of claim 15 further comprising:

a pair of support arms extending laterally from the elongate stem;

wherein the support arms each abut a respective breast when the ornament is worn by a wearer to assist in the positioning of the ornament in the cleavage.

* * * * *